United States Patent [19]

David

[11] 4,011,780

[45] Mar. 15, 1977

[54] APPARATUS FOR TRIMMING AND/OR SUBDIVIDING MILL PRODUCT AT A COIL FORMING STATION

[75] Inventor: Siegfried David, Hilchenbach, Germany

[73] Assignee: Morgan Construction Company, Worcester, Mass.

[22] Filed: Mar. 10, 1976

[21] Appl. No.: 665,402

[30] Foreign Application Priority Data

Apr. 10, 1975 Germany ..... 2515643

[52] U.S. Cl. ..... 83/167; 83/598; 83/607; 83/907; 140/2

[51] Int. Cl.[2] ..... B21F 11/00

[58] Field of Search ..... 83/167, 598, 607, 907; 140/2; 242/80, 83, 78, 79; 72/275, 280

[56] References Cited

UNITED STATES PATENTS

| | | | |
|---|---|---|---|
| 3,776,076 | 12/1973 | Hauck | 83/167 |
| 3,850,204 | 11/1974 | Hauck | 140/2 |

FOREIGN PATENTS OR APPLICATIONS

| | | | |
|---|---|---|---|
| 442,932 | 1/1968 | Switzerland | 83/907 |

*Primary Examiner*—Frank T. Yost
*Attorney, Agent, or Firm*—Thompson, Birch, Gauthier & Samuels

[57] ABSTRACT

An apparatus is disclosed for trimming and or subdividing rod or other similar mill products at a coil forming station. The rod, which may have previously been formed into overlapping rings on a conveyor, is carried to the upper end of an upstanding cylindrical chamber overlying an axially aligned mandrel. The rings drop from the conveyor through the chamber onto the mandrel where they are collected in coil form. Separating fingers are movable into the chamber to temporarily interrupt the descent of rings therethrough, with the rings above the separating fingers being connected to the rings accumulated around the underlying mandrel by a single connecting strand. Pivotal arms, preferably sickle-shaped, are movable beneath the separating fingers across the path of ring descent. Each pivotal arm carries a shear blade which cooperates with a stationary shear blade located at the periphery of the path of ring descent. The connecting strand is carried by one of the aforesaid arms through a short distance to the periphery of the path of ring descent where the strand is cut by the cooperating shear blades.

6 Claims, 3 Drawing Figures

APPARATUS FOR TRIMMING AND/OR SUBDIVIDING MILL PRODUCT AT A COIL FORMING STATION

DESCRIPTION OF INVENTION

This invention relates generally to rolling mills wherein the mill product, for example rod, has been formed into overlapping non-concentric rings on a conveyor leading to a coil forming station. The invention is concerned in particular with a novel and improved apparatus for trimming and/or subdividing the mill product at the coil forming station.

A number of prior art devices of the type referred to above have heretofore been developed. Examples of such devices are disclosed in German patent publication Nos. AS 1,235,100, OS 2,141,972 and OS 2,150,419.

In German Pat. No. 1,235,100, there is disclosed an arrangement wherein overlapping non-concentric product rings are carried by a conveyor to the upper end of a cylindrical reforming chamber. The rings are dropped from the conveyor through the chamber onto a underlying mandrel where they accumulate in coil form.

At the lower end of the chamber are provided two intercepting half plates, movable in opposite directions. Normally, that is, while the product coil is being formed, the half plates are positioned outside of the vertical path of ring descent through the chamber. As soon as the coil forming on the mandrel has attained a desired size or a given weight, the two half plates are moved into the path of ring descent with a narrow slot remaining between the forward edges thereof. A connecting product strand thus extends downwardly from the rings which thereafter accumulate on the half plates through said slot to the rings accumulated in coil form around the underlying mandrel. A catching lever is pivotally mounted on each of the half plates. These levers can be moved across the range of the slot to catch and guide the connecting product strand extending downwardly therethrough to one of two shears which are located at the bottom of the chamber at opposite ends of the slot. These shears operate to cut the connecting strand. A problem with this type of known device, however, is that the connecting strand is deformed or bent while being moved into the operative range of the shears. Bent or deformed ends impair the removal of the underlying coil, as well as its subsequent compacting and typing. Moreover, such bent or deformed ends can be hazardous to operating personnel. Consequently, it becomes necessary to manually trim the bent or deformed ends before the coils are handled further.

German Pat. No. OS 2,141,972 discloses an arrangement somewhat similar to that disclosed in German Pat. No. AS 1,235,100, except that instead of intercepting half plates movable in opposite directions, there is provided at least three guide elements pivoted on vertical axes outside of the path of ring descent. These guide elements are moved either simultaneously or sequentially into the path of ring descent and form thereby a central opening through which projects the connecting product strand that is to be cut. One of the guide elements is equipped with a shear which operates on the connecting strand at the central opening. This device also has the disadvantage that the connecting strand, while being centered prior to the cutting operation, becomes deformed or bent.

From German Pat. No. OS 2,150,419 there is likewise known a device for the dividing of product at a coil forming station, whereby a ring is pivoted underneath and outside of the coil forming chamber. This ring is provided with at least one shear whose movable blade is mounted on an arm that bridges the circular slot between the chamber and a collector arbor. To cut a connecting strand, the shear is swiveled into place and subsequently the ring carrying the shear is turned until the arm carrying the movable blade has seized the connecting strand. Thereafter, the connecting strand, positioned between the two shear blades, can be cut without deforming. Although this device makes possible an improved cut, it is expensive, complicated and susceptible to frequent breakdowns.

It is, accordingly, an object of the present invention to provide a novel and improved apparatus for trimming and/or subdividing the product of a rolling mill at a coil forming station which obviates or at least substantially minimizes the problems and disadvantages described above.

A specific object of the present invention is the provision of an apparatus for trimming and/or subdividing mill product at a coil forming station without bending or distorting the cut ends.

A further object of the present invention is the provision of an apparatus of the above-described type which is simple in design, relatively inexpensive to fabricate, and capable of extended periods of trouble free operation.

These and other objects and advantages of the present invention will become more apparent as the description proceeds with the aid of the accompanying drawings, wherein.

Figure 1:
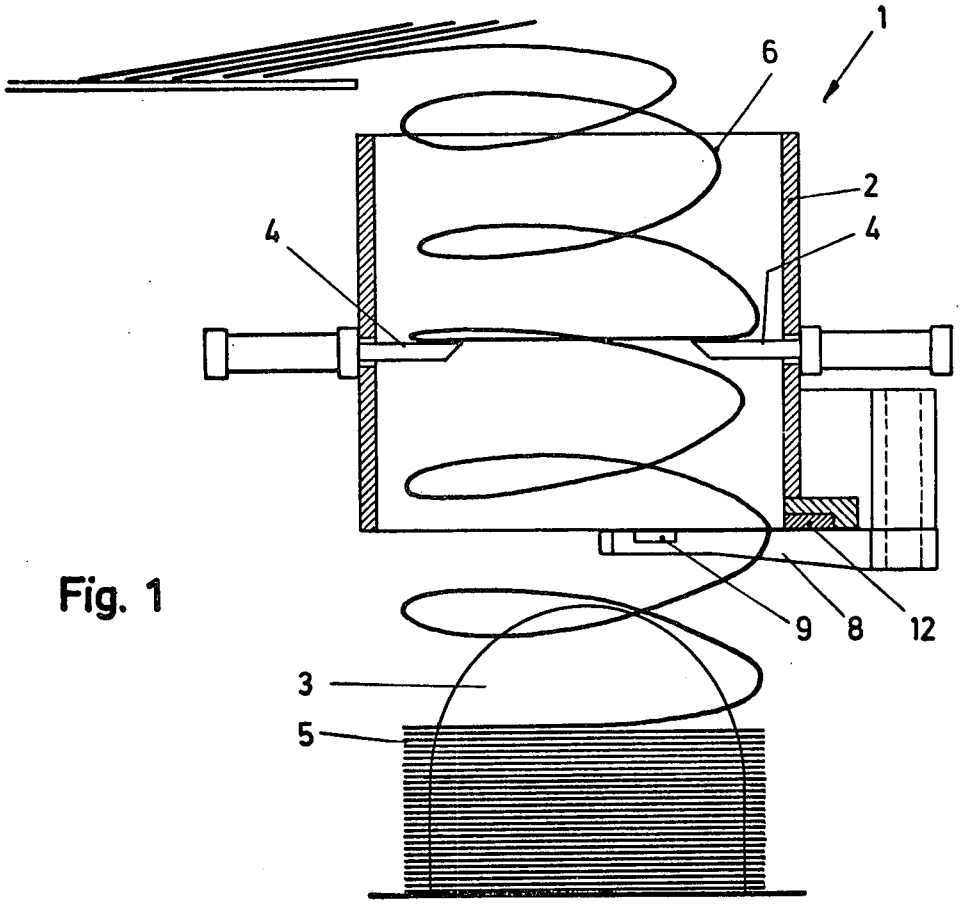
FIG. 1 is a somewhat schematic vertical sectional view of a preferred embodiment of an apparatus constructed in accordance with the present invention.

Referring initially to FIG. 1, there is generally indicated at 1 a coil forming station which includes an upstanding cylindrical reforming chamber 2 overlying an axially aligned collecting mandrel 3. The upper end of the reforming chamber 2 is located adjacent to the delivery end of a moving conveyor carrying overlapping non-concentric product rings. The mandrel 3 is located below the bottom edge of the chamber 2. A plurality of separating fingers 4 are mounted on the chamber 2 and are movable into and out of the vertical path of ring descent therethrough. The separating fingers can be operated either through individual drives such as for example the cylinders shown in the drawings, or if desired through a common drive in a manner known to those skilled in the art. When the separating fingers 4 are operatively advanced as shown in FIG. 1, they interrupt the descent of product rings through the chamber, thereby separating the rings 5 already accumulated on the mandrel 3 from the rings 6 which continue to descend vertically into the chamber.

A plurality of levers 7 are pivotally mounted for movement about axes located externally of the reforming chamber 2. Each lever 7 has a catching arm 8 which is preferably shaped in the form of a sickle. Each catching arm 8 has a shear blade 9 attached thereto at the base of the sickle notch.

Figure 2:
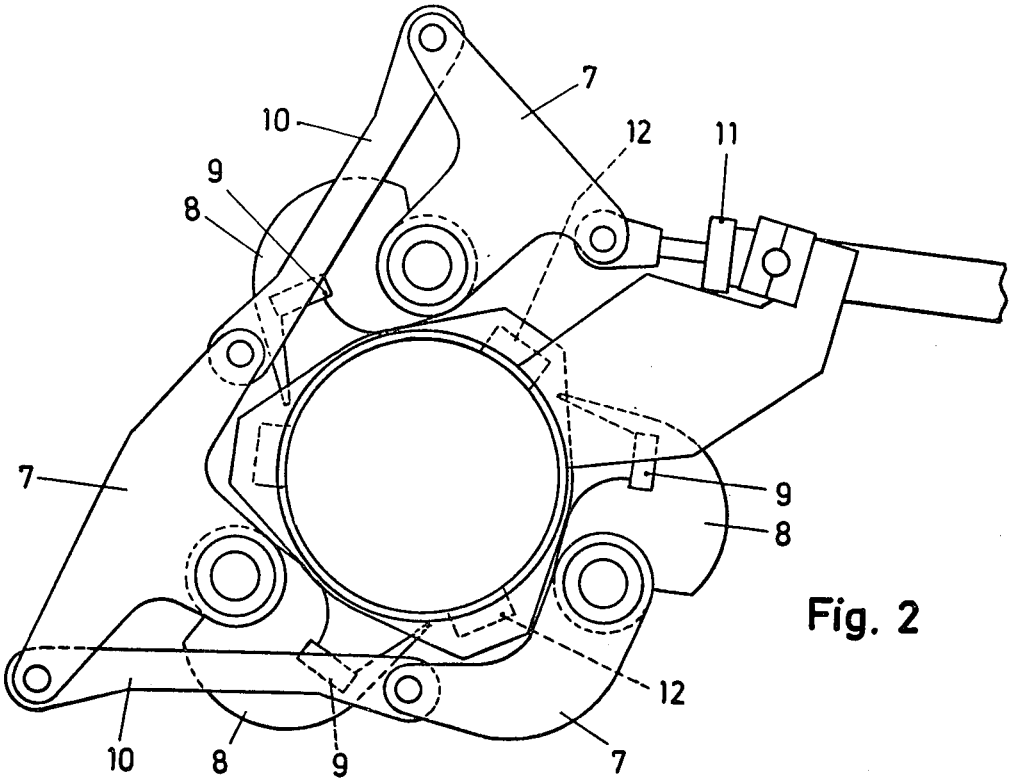
FIG. 2 is a plan view of the apparatus shown in FIG. 1 with the components thereof adjusted to the inoperative position during formation of a coil.
Figure 3:
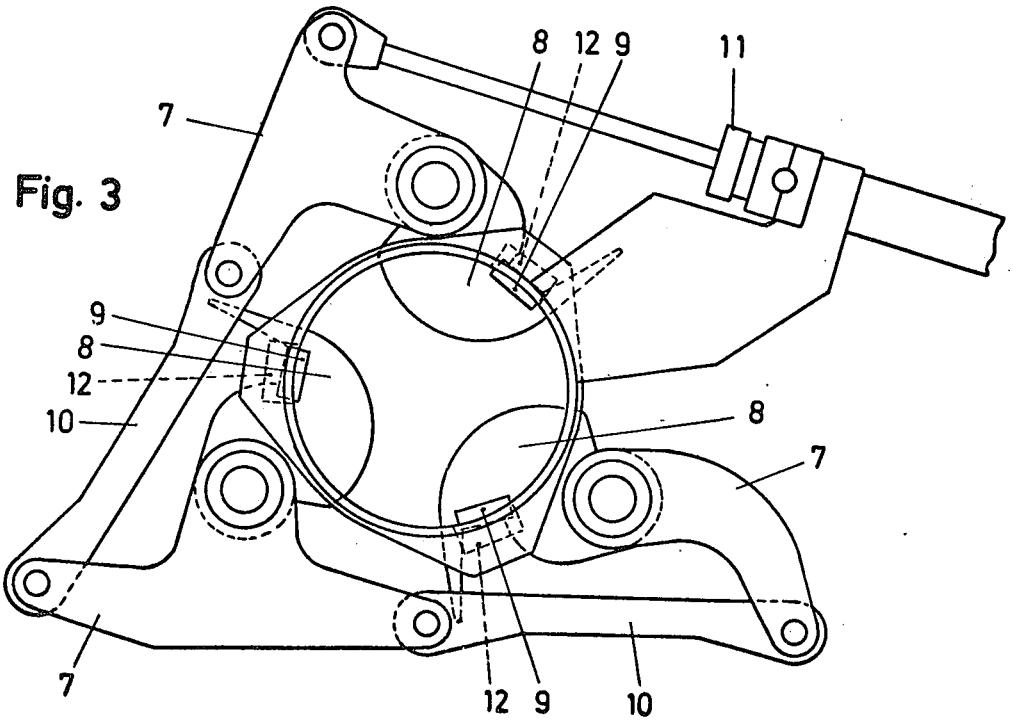
FIG. 3 is a view similar to FIG. 2 with the components thereof adjusted to their operative "cut" positions.

The levers 7 and their catching arms 8 are normally inoperatively positioned as shown in FIG. 2 outside of the path of ring descent through the reforming chamber 2. In the preferred embodiment herein being described, the levers 7 are pivotally interconnected by means of links 10 in a manner such that all of the levers 7 and their respective catching arms 8 can be simultaneously adjusted from the positions shown in FIG. 2 to the positions shown in FIG. 3. This movement preferably is accomplished by a single piston-cylinder unit 11 which may be either hydraulically or phenumatically actuated.

Stationary shear blades 12 are provided at the bottom edge of the reforming chamber 2 at circumferentially spaced locations around the path of ring descent. The blades 12 are positioned to cooperate with the blades 9 on the catching arms 8, there being one blade 12 for each blade 9 and its associated catching arm.

The apparatus of the present invention operates in the following manner: during formation of a coil about the mandrel 3, the separating fingers 4 are retracted from the reforming chamber 2 and the pivotal levers 7 ae retracted to their inoperative positions as shown in FIG. 2. As soon as a sufficient quantity of rings has been accumulated about the mandrel 3, the separating fingers 4 are advanced to their operative positions shown in FIG. 1. Thereafter, rings will continue to accumulate temporarily above the fingers 4, and the first of these rings will be connected to the last ring deposited around the mandrel 3 by a single connecting strand. This connecting strand is cut by operating piston-cylinder unit 11 to adjust the pivotal levers 7 to their operative positions shown in FIG. 3. During this adjustment, the sickle-shaped catching arms 8 sweep across the path of ring descent at a plane located slightly below the bottom edge of the reforming chamber 2 and well below the intercepting fingers 4. The positioning, shape and dimensions of the arms 8 is such that one of the arms will pick up the connecting strand and carry it towards the periphery of the path of ring descent which is defined by the reforming chamber 2. As the connecting strand thus being carried, it will locate itself against the cutting blade 9 of a catching arm 8 and this cutting blade is arranged to cooperate with a stationary blade 12 to cut the connecting strand.

As soon as this cut has been made, the coil formed around mandrel 3 can be cleared from beneath the reforming chamber 2. This can be done in a number of ways, for example, either by moving the mandrel laterally and positioning a fresh mandrel beneath the reforming chamber, or by axially retracting the mandrel and thereafter pushing the coil laterally by other associated means. In any event, as soon as an empty mandrel has been repositioned beneath the reforming chamber, the levers 7 and their associated catching arms 8 have been returned to the positions shown in FIG. 2, the intercepting fingers 4 are retracted to allow the rings temporarily accumulated thereon to drop through the reforming chamber onto the mandrel 3 as the next coil forming operation begins.

Having thus described a preferred embodiment of the present invention, its advantages will now be apparent to those skilled in the art. Among these advantages is the fact that during a cutting operation of a connecting strand, the strand is moved through a minimal distance to the closest peripheral section of the reforming tub 2 by means of one of a plurality of pivotal catching arms 8. This substantially minimizes any tendency for distortion or bending of the connecting strand. Also, the actual cutting mechanism is simple and relatively foolproof, being comprised of one blade 9 on a catching arm 8 and another cooperating blade 12 mounted in a fixed position at the lower edge of the reforming chamber 2.

In order to insure that the connecting strand is cut at an angle which is substantially perpendicular to its longitudinal axis, it is within the contemplated scope of the present invention to arrange the cooperating shear blades 9, 12 obliquely with regard to the horizontal plane of movement of the catching arms 8.

It is my intention to cover all changes and modifications of the embodiment herein chosen for purposes of disclosure which do not depart from the spirit and scope of the invention.

I claim:

1. Apparatus for trimming and/or subdividing a product length, for example rolled rod which has previously been formed into a series of rings, said apparatus comprising: an upstanding cylindrical reforming chamber positioned to receive and guide said rings downwardly along a vertical path of ring descent; a support positioned beneath said reforming chamber to receive the rings descending therethrough and to collect said rings in coil form; separating means movable into said reforming chamber to interrupt the descent of rings therethrough, with the rings thereafter accumulating on said separating means being connected to the rings accumulated in coil form on said support by a single connecting strand; a plurality of stationary first shear blades circumferentially spaced around the periphery of the path of ring descent at a level beneath that of said separating means; and a plurality of catching arms movable across the path of ring descent to carry the connecting strand towards one of said stationary shear blades, each of said catching arms having a second shear blade arranged thereon to cooperate with one of said first shear blades to cut the connecting strand.

2. The apparatus as claimed in claim 1 wherein said catching arms are sickle-shaped, with said second shear blades being mounted thereon at the base of the sickle notch.

3. The apparatus as claimed in claim 1 wherein said catching arms are operated by levers pivotally mounted for movement about axes located externally of said reforming chamber.

4. The apparatus as claimed in claim 3 wherein said levers are pivotally interconnected by links, and wherein pivotal movement of said levers and their associated catching arms is accomplished by means of a single piston-cylinder unit.

5. The apparatus as claimed in claim 1 wherein the product length has previously been formed into a series of overlapping non-concentric rings on a moving conveyor, and wherein the upper end of said reforming chamber is positioned adjacent to the delivery end of said conveyor.

6. The apparatus as claimed in claim 1 wherein the number of said stationary first shear blades is identical to the number of said second shear blades and the catching arms on which said second shear blades are mounted.

* * * * *